US010299576B2

(12) United States Patent
Rose et al.

(10) Patent No.: US 10,299,576 B2
(45) Date of Patent: May 28, 2019

(54) STRAP FOR RETAINING ARTICLES

(71) Applicant: Amer Sports Canada Inc., North Vancouver (CA)

(72) Inventors: Gordon T. Rose, Bowen Island (CA); Carl Moriarty, North Vancouver (CA)

(73) Assignee: Amer Sports Canada Inc., North Vancouver, British Columbia (CA)

( * ) Notice: Subject to any disclaimer, the term of this patent is extended or adjusted under 35 U.S.C. 154(b) by 0 days.

(21) Appl. No.: 15/828,113

(22) Filed: Nov. 30, 2017

(65) Prior Publication Data

US 2018/0153289 A1 Jun. 7, 2018

Related U.S. Application Data

(60) Provisional application No. 62/428,850, filed on Dec. 1, 2016.

(51) Int. Cl.
*A45F 5/10* (2006.01)
*A63C 11/02* (2006.01)

(52) U.S. Cl.
CPC ..... *A45F 5/102* (2013.01); *A63C 11/025* (2013.01); *A45F 2005/108* (2013.01); *A45F 2005/1013* (2013.01); *A45F 2005/1066* (2013.01); *A63C 2203/44* (2013.01)

(58) Field of Classification Search
CPC ..... Y10T 24/1498; Y10T 24/3416; Y10T 24/3417; Y10T 24/4755; A45F 3/14; A45F 5/102; A45F 2005/1013; A45F 2005/1066; A45F 2005/108; A45C 2013/306; A45C 2203/44; A45C 11/025; A44B 11/00
USPC ..... 224/250
See application file for complete search history.

(56) References Cited

U.S. PATENT DOCUMENTS

| | | | | |
|---|---|---|---|---|
| 489,656 | A * | 1/1893 | Moores | A44B 11/22 24/176 |
| 2,663,062 | A * | 12/1953 | Abel | A44B 11/22 24/163 R |
| 3,121,270 | A | 2/1964 | Van Den Broek et al. | |
| 4,817,837 | A | 4/1989 | Grover | |
| 5,575,011 | A | 11/1996 | Allen | |
| 8,875,355 | B2 | 11/2014 | Sartin | |
| 9,380,838 | B2 * | 7/2016 | Iannello | A45F 5/00 |
| 10,143,865 | B2 | 12/2018 | Franke et al. | |
| 2012/0168473 | A1 * | 7/2012 | Arajakis | A45F 5/00 224/250 |
| 2015/0257493 | A1 | 9/2015 | Skipper et al. | |

* cited by examiner

*Primary Examiner* — Adam J Waggenspack
(74) *Attorney, Agent, or Firm* — Terence P. O'Brie; Todd A. Rathe

(57) ABSTRACT

A strap for releasably retaining one or more articles. The strap includes a flexible elongate body and a buckle coupled to the first end. The body has a first region adjacent a first end of the body, a second region adjacent a second end of the body, and a central region positioned between the first and second regions. The central region of the body defines a plurality of spaced apart fastening holes. The first region defines a strap opening for receiving the second end of the strap and releasably engaging a portion of the body. The buckle includes a frame including a proximal region coupled to the first end of the body, a distal region, and first and second side regions between the proximal and distal region. The second side region includes a gateway for releasably receiving any region of the body.

20 Claims, 10 Drawing Sheets

STRAP FOR RETAINING ARTICLES

RELATED U.S. APPLICATION DATA

The present application claims priority to U.S. Provisional Patent Application Ser. No. 62/428,850 filed on Dec. 1, 2016, which is hereby incorporated by reference in their entirety.

FIELD OF THE INVENTION

The present invention relates generally to an improved strap for releasably retaining skis or other articles.

BACKGROUND OF THE INVENTION

Many sports and outdoor recreation articles, such as skis, can be large in size and difficult to transport. Straps and other retaining devices have been developed to facilitate retaining and transporting such articles. Although existing straps can be used to retain such articles, they typically include drawbacks. Such existing straps typically flat elongate structures that are configured to work in one orientation. However, such continuous flat configuration can make it difficult for user to readily place such straps into the proper orientation during use. As a result, users of such straps often have to restart the efforts to wrap and retain such straps about the skis or other articles. Existing straps often are highly elastic and rely substantially upon the tension developed upon the initial application to keep the strap connected. When such straps are manipulated such that the tension is reduced, the engagement of the buckle of such straps can be released due to the loss of tension in the strap. Existing straps typically include a conventional buckle arrangement with a closed frame and prong configuration wherein the user must thread the free end of the strap through the closed frame in order to properly retain the strap. The need to thread the free end of the strap through the close frame of the buckle makes use of such existing straps more difficult to use and typically requires more time to manipulate. Existing straps are also typically not configured to be easily stored or retained when not in use, and as a result, such straps are more prone to being lost or misplaced when not in use.

Thus, a continuing need exists for a strap for retaining sporting and outdoor recreational articles, such as skis, that is easy to use and requires little time to engage about and retain such articles. It would be advantageous to provide a strap for retaining articles that is intuitively easy to orientate and use. What is needed is a strap for retaining articles, such as skis, that stays connected even when not under tension, and can be readily retained when not in use. Further, there is a need for a strap that meets these needs while also providing an improved, pleasing aesthetic.

SUMMARY OF THE INVENTION

One implementation of the present invention provides a strap for releasably retaining one or more articles. The strap includes a flexible elongate body and a buckle coupled to the first end. The body has a first region adjacent a first end of the body, a second region adjacent a second end of the body, and a central region positioned between the first and second regions. The central region of the body defines a plurality of spaced apart fastening holes. The first region defines a strap opening for receiving the second end of the strap and releasably engaging a portion of the body. The buckle includes a frame including a proximal region coupled to the first end of the body, a distal region, and first and second side regions between the proximal and distal region. The second side region includes a gateway for releasably receiving any region of the body.

According to another implementation of the invention, a backpack assembly includes a backpack including a support bracket defining a plurality of spaced apart slots, and an elongate strap for selectable engagement with the support bracket. The strap includes a flexible elongate body and a buckle. The flexible elongate body has a first region adjacent a first end of the body, a second region adjacent a second end of the body, and a central region positioned between the first and second regions. The first region includes a transversely extending tab. The central region of the body defines a plurality of spaced apart fastening holes. The buckle is coupled to the first end and includes a frame. The frame has a proximal region coupled to the first end of the body, a distal region, and first and second side regions between the proximal and distal region. The second side region includes a gateway for releasably receiving any region of the body. Each of the spaced apart slots are sized to releasably receive the first end of the body and to resiliently received the transverse tab. The tab, when threaded through at least one of the slots, forms a stop for facilitating retention of the strap to the support bracket.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
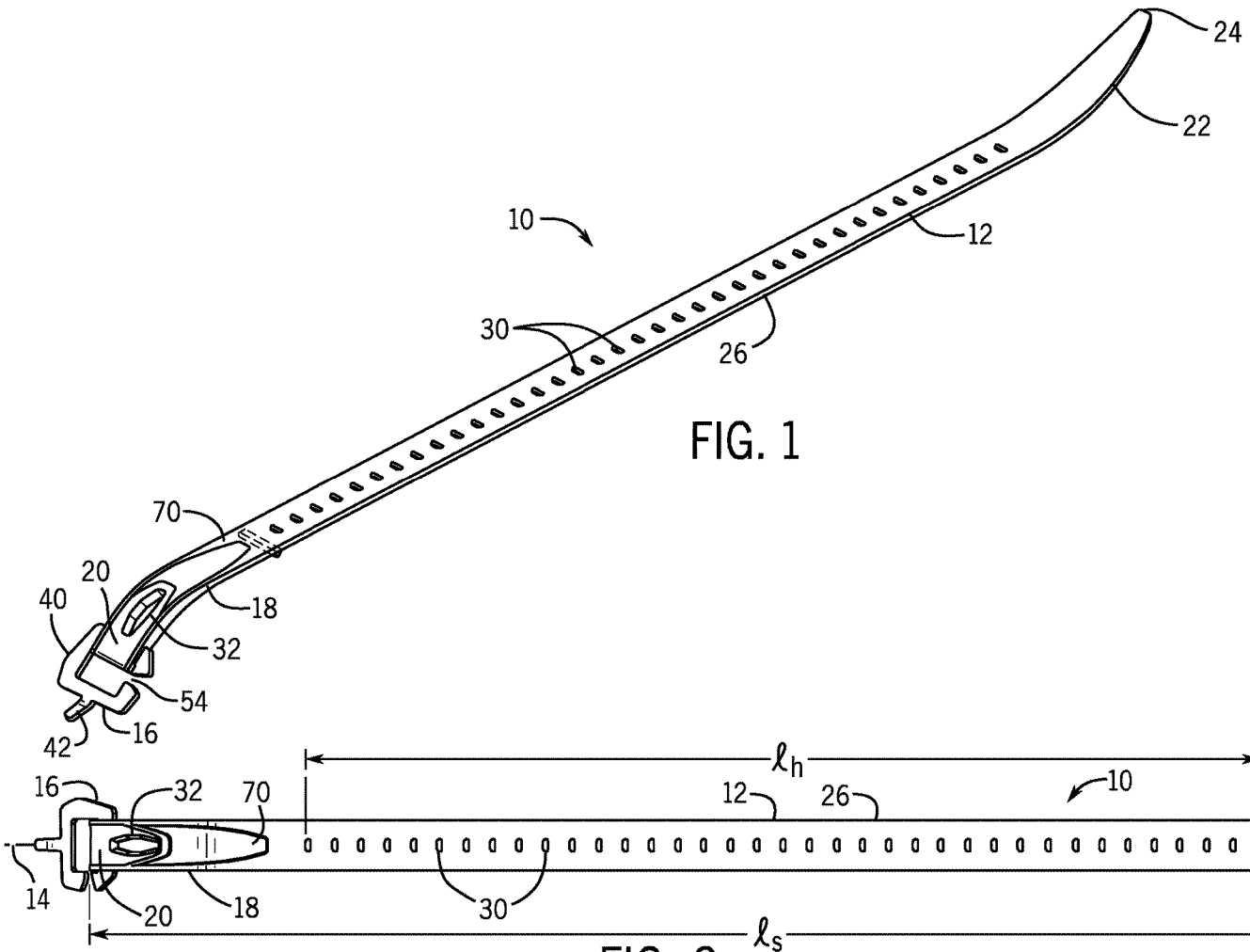
FIG. 1 is a perspective view of a strap in accordance with one implementation of the present invention.

Referring to FIGS. 1 through 5A, a strap is indicated generally at 10. The strap 10 is an elongate fastener configured for releasably retaining sporting and/or outdoor recreational articles, such as skis. The strap 10 includes an elongate, flexible body 12 that can extend along a longitudinal axis 14 and a buckle 16.

The body 12 is an elongate flexible, durable, thin strip. The body 12 includes a first region 18 adjacent a first end 20, a second region 22 adjacent a second end 24 and a central region 26 positioned between the first and second regions 18 and 22. The body 12 is formed of a lightweight, strong, flexible, durable material, preferably as an elastomeric thermoplastic material. In alternative embodiments, the body 12 can be formed of other materials such as, polyurethane, leather, synthetic leather, textiles, other polymeric materials, and combinations thereof. The body can be formed as one single integral piece or as a multi-sectional and/or multi-layered structure. In one implementation, the body 12 can be resilient. In another implementation, the body 12 is formed of a material that has a small level of elasticity or resiliency thus its length is substantially constant even when placed under tension.

Figure 2:
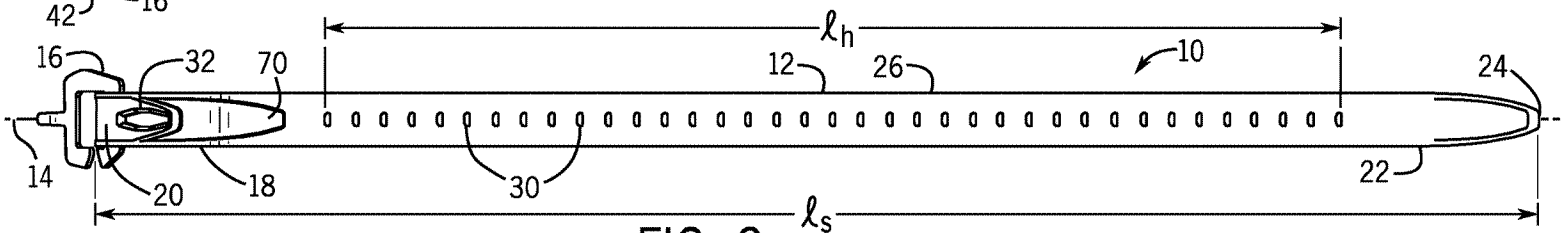
FIG. 2 is a top view of the strap of FIG. 1.

The body 12 includes a plurality of longitudinally spaced apart fastening holes 30 extending generally in-line with the longitudinal axis 14. The holes 30 can be positioned only on the central region 26 or on two or more regions of the body 12. The holes 30 are releasably and selectively engage the buckle 16 and are configured to allow for adjustable fastening of the strap 10 to an article, such as skis, by adjusting the needed or effective length of the strap 12. In one implementations, the number spaced apart holes 30 is at least 10. In another implementation, the number of spaced apart holes 30 is at least 20. In another implementation, the number of spaced apart holes 30 is at least 30. In one implementation, the holes 30 can have an oval shape. In other implementations, the holes can have a rectangular shape, an octagonal shape, a trapezoidal shape, other polygonal shapes, a circular shape, a crescent shape, an irregular shape, and combinations thereof. Referring to FIG. 2, the body 12 has a first length $l_s$ when placed about, and measured with respect to, a horizontal surface. The plurality of spaced apart holes 30 extend along the body 12 to define a portion of the body 12 that includes the holes 30. This portion of the body 12 including the holes 30 defines a second length $l_h$. In one implementation, the second length $l_h$ is at least 50 percent of the first length $l_s$. In another implementation, the second length $l_h$ is at least 70 percent of the first length $l_s$.

Figure 3:
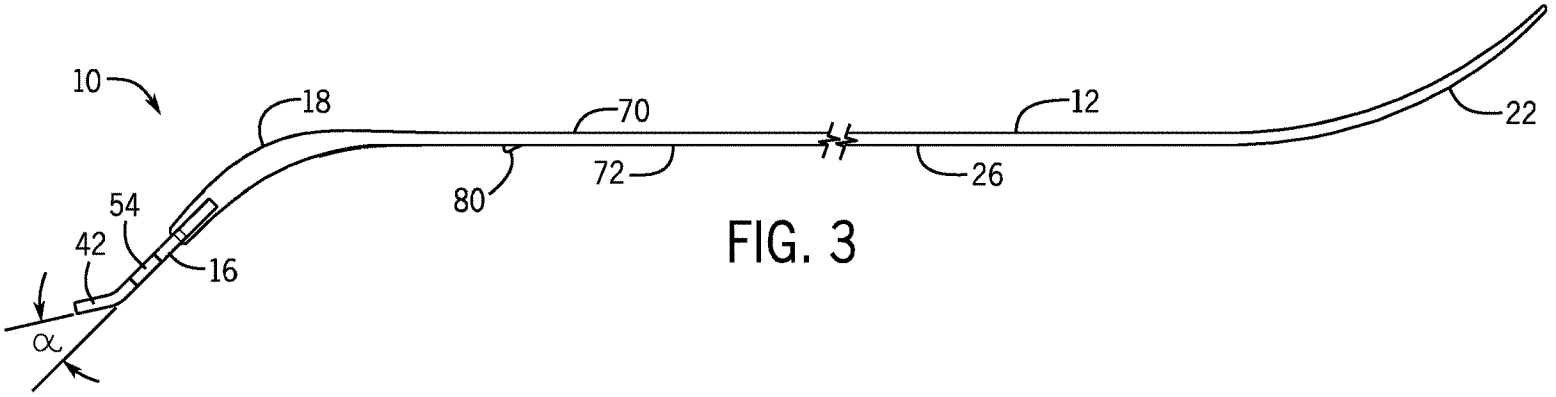
FIG. 3 is a side view of the strap of FIG. 1.
Figure 4:
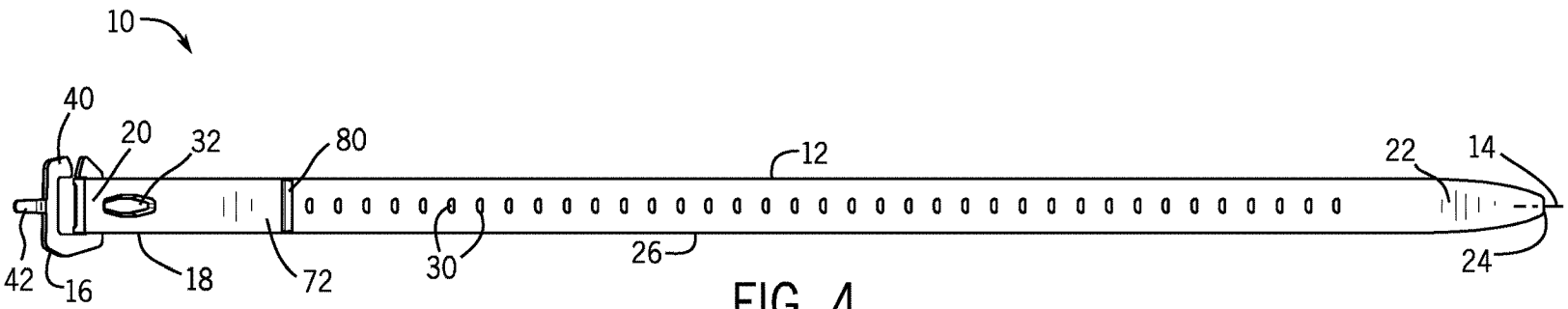
FIG. 4 is a bottom view of the strap of FIG. 1.

In one implementation, the first region 18 of the body 12 can be formed with a curvature, as best shown in FIG. 3. In one implementation, the first region 18 can be molded to produce the curvature. In other implementations, other techniques can be used to form or create the curvature. The curvature provides two distinct orientations of the body 12, such that the user upon viewing or grasping the body can readily ascertain an outer surface 70 and an inner surface 72 of the body 12. The curvature allows for the immediate recognition of the orientation of the body 12 and facilitates the manipulation of the body 12 by the user by enabling the user to readily ascertain which surface he or she is viewing. As a result, the use of the strap 10 to retain an article can be more efficient because the user is less likely to mistake which surface is the inner surface and which is the outer surface of the strap. In another implementation, the body can be formed without a pre-formed curvature.

Referring to FIGS. 1, 2, 4, 5A, 6 and 7, the first region 18 of the body 12 defines a strap opening 32 for releasably receiving the free or second end 24 and other portions of the body as selected by the user. The strap opening 32 is preferably sized to create an interference fit with the portions of the body 12 extending through it. The opening 32 has a major dimension that in one implementation is generally aligned with the longitudinal axis 14 of the body 12 and is sized to be substantially equal to or slightly less than the width of the body 12. In one implementation, the opening 32 has a minor dimension that is equal to or greater than the thickness of the body 12. In other implementations, the major and/or minor dimension of the opening 32 can be sized to be slightly less than the width and/or thickness of the body, equal to the width and/or thickness of the body, greater than the width and/or thickness of the body, and combinations thereof. In one implementation, the major dimension of the opening can be within the range of 0.1 inch to 2.0 inches, and the minor dimension can be within the range of 0.005 to 0.1 inch. In another implementation, the major dimension can be within the range of 0.25 inch to 1.0 inch, and the minor dimension can be within the range of 0.020 to 0.070 inch. In other implementations, the major and minor dimensions can have other sizes or size ratios. In other implementations, the major dimension of the opening 32 can be angled with respect to the longitudinal axis 14. In one set of implementations, the major dimension can be angled within the range of −45 degrees to +45 degrees from the longitudinal axis 14. The opening 32 is shown as having generally octagonal shape. In other implementations, the opening can have other shapes such as, for example, a rectangular, other polygonal shapes, an oval shape, a circular shape, an irregular shape and combinations thereof. The second region 22 of the body 12 can be tapered to facilitate the routing of the second end 24 and the second region 22 through the opening 32.

Figure 6:
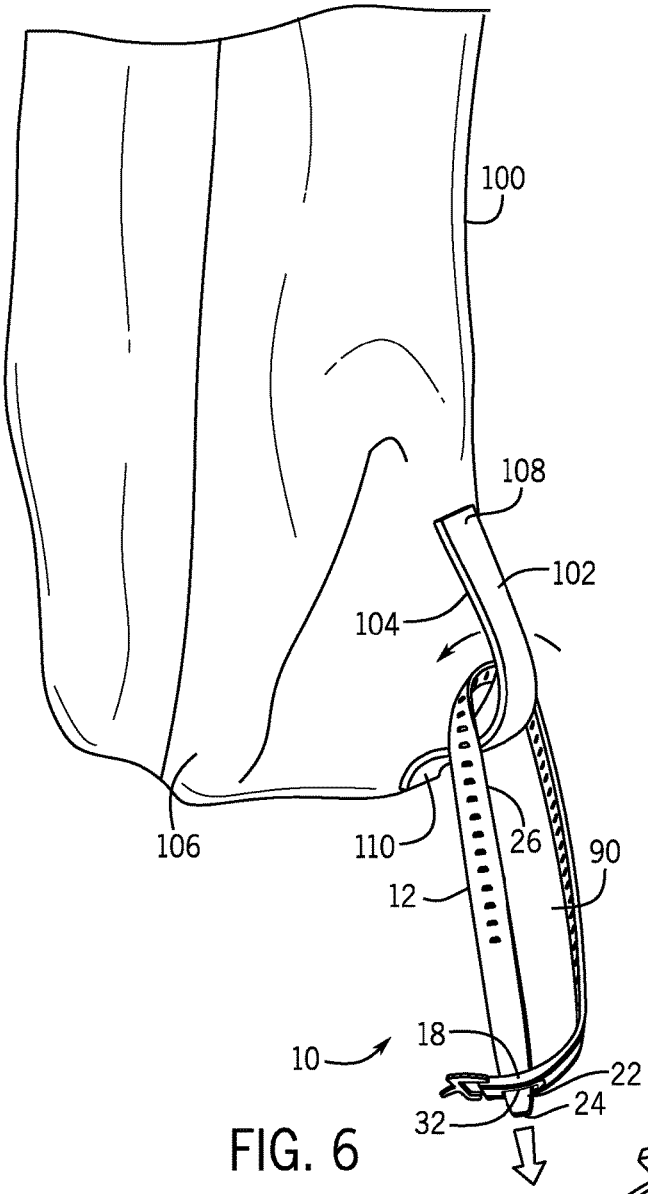
FIG. 6 is a rear side perspective view of a backpack and the strap of FIG. 1 being releasably attached to a tie of the backpack.
Figure 7:
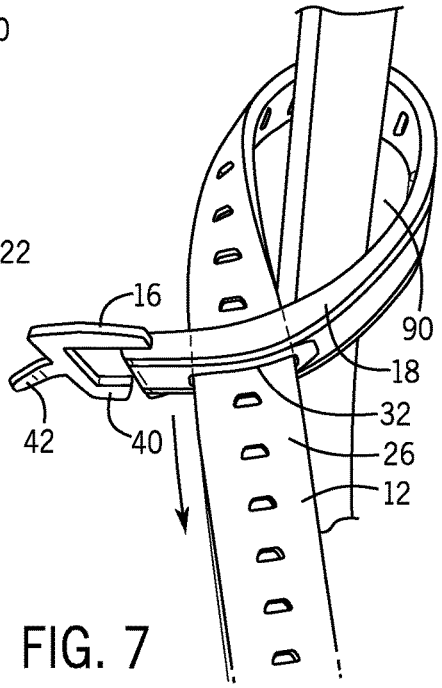
FIG. 7 is a rear perspective view of the strap of FIG. 1 being releasably attached to the tie of the back pack of FIG. 6.

Referring to FIGS. 6 and 7, the strap 10 is shown being releasably attached to a flexible support 102 (or a tie) of a backpack 100. The flexible support 102 is attached to a body 106 of the backpack 100 at two spaced apart connection locations 108 and 110 to form a flexible support opening 104 for receiving the strap 10 or other articles, such as, for example, a carabiner (not shown). In FIG. 6, the second end 24 and the second region 22 of the body 12 of the strap 10 are shown drawn through the flexible support opening 104 and being routed or drawn through the opening 32 forming an enlarged loop 90. In FIG. 7, the second region 22 and a majority of the central region 26 are shown extending through the opening 32. As more of the central region 26 is drawing through the opening 32, the strap 10 tightens about the flexible support 102 and the size of the loop 90 shrinks as desired by the user. The amount of extension of the other portions of the body 12 into the opening 32, and size of the loop 90, is selectably adjustable by the user by simply grasping the body 12, threading the second end 24 through the opening 32, and then pulling the second region 22 of the body 12 until the desired amount or length of insertion of the body 12 into and through the opening 32 is achieved. The opening 32 is sized so as to form an interference fit with the body 12 extending through the opening 32. Once inserted, the user can easily and readily adjust the length of the engagement, or remove the engaged portion or portions of the body 12 from the opening 32, by pulling or pushing the body 12 from either side of the opening 32. Accordingly, the strap 10 with the opening 32 is configured for quick and efficient releasable attachment to the flexible support 102 or any attachment location on a backpack or other structure. The opening 32 provides a user with the ability to quickly and efficiently retain the strap 10 on a backpack 100 or other article when the strap 10 is not being used to retain a separate article, such as, for example, a pair of skis.

Figure 5A:
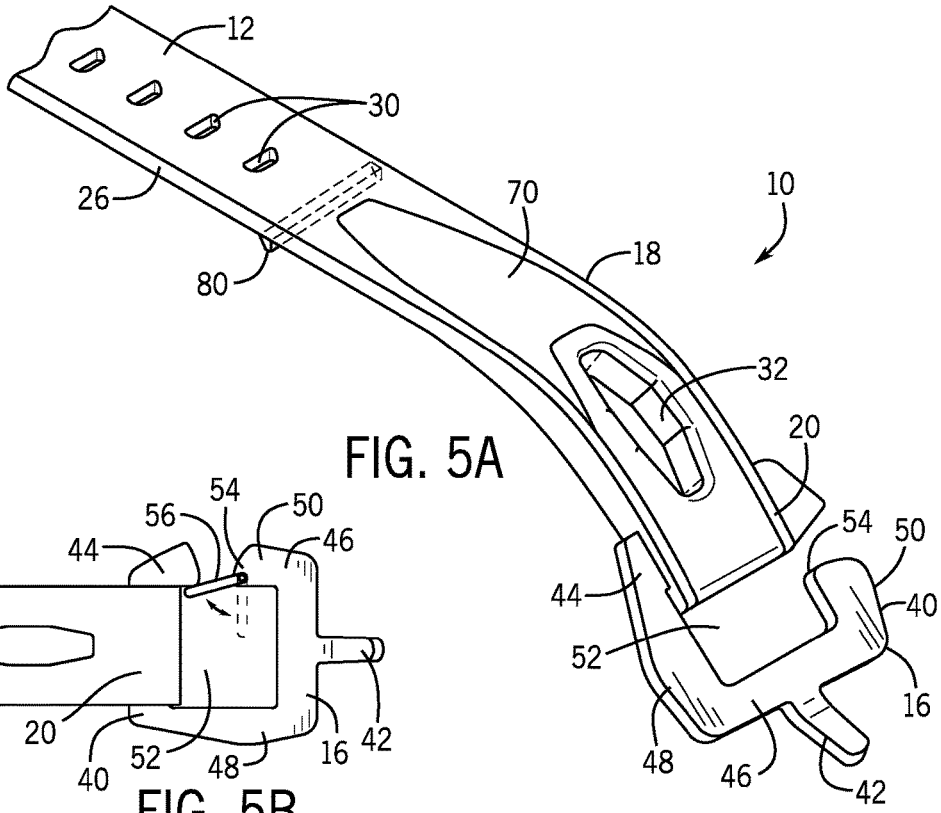
FIG. 5A is a top perspective view of a first region and a buckle of the strap of FIG. 1.
Figure 8:
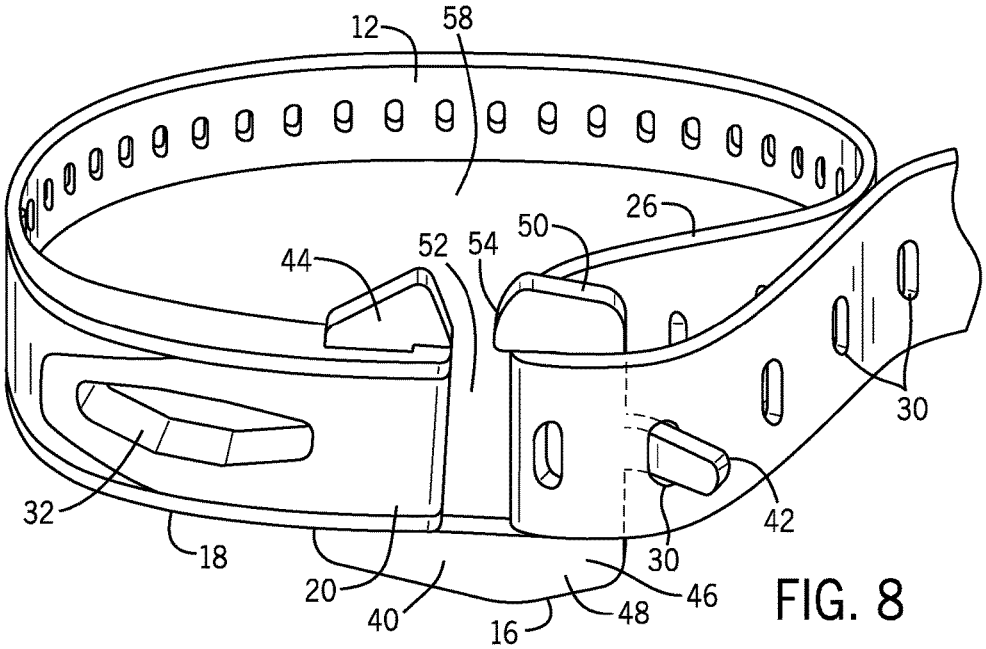
FIG. 8 is a perspective view of the strap of FIG. 1 shown in one of a plurality of fastened positions.

Referring to FIGS. 5A and 8, the buckle 16 includes a frame 40 and a prong 42. The frame 40 includes a proximal region 44 coupled to the first end 20 of the body 12, a distal region 46 and first and second side regions 48 and 50 between the proximal and distal regions 44 and 46. The frame 40 is a rigid structure formed of a strong, durable material, such as metal. In other implementations, the frame can be formed of other strong, durable and substantially rigid structures such as a fiber composite material, wood, a ceramic, a polymeric material, other metals, other alloys and combinations thereof. The frame 40 generally defines a central enlarged opening 52 for receiving the body 12. The proximal region 44 is coupled to the first end 20 of the first region 18. In one implementation, the proximal region 44 is pivotally coupled to the first end 20. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another.

The second side region 50 can include or define a gateway 54 for releasably receiving a portion of the body 12. The gateway 54 is continuous with, and essentially provides access to, the central enlarged opening 52. The gateway 54 enables a user to insert a portion of the body 12 within the opening 52 without having to thread the second end 24 of the body 12 through the opening 52 of the buckle 16. The gateway 54 enables a user to insert the central region 26, the second regions 22 and even portions of the first region 18 into the opening 52 of the buckle 16 without having to thread the body through the opening of the buckle 16. The gateway 54 thereby enables a user to quickly and easily selectably engage or disengage the buckle 16 with any region of the body 12. The gateway 54 provides the user the ability to more quickly manipulate the strap 10 to engage and/or retain one or more articles, such as a pair of skis. The gateway 54 creates a gap or space in the second side region 50, measured with respect to the longitudinal axis 14 of at least the thickness of the body 12. In one implementation, the gateway 54 creates a gap or space of at least 10 mm when measured with respect to the longitudinal axis 14. In another implementation, the gateway 54 creates a gap or space of at least 20 mm when measured with respect to the longitudinal axis 14.

As shown in FIG. 8, the second side region 50 is shaped to retain the portion of the body 12 within the opening 52 of the buckle 16 once the portion of the body 12 has been inserted by the user. Once the portion of the body 12 is inserted through the gateway 54, the user can then move the body 12 toward the prong 42 and align one of the plurality of holes 30 with the prong 42. The user can then continue to move the body 12 so that the prong 42 extends through the selected hole 30 to retain the body 12. When the prong 42 is inserted within a selected one of the plurality of holes 30, the strap 10 forms an enclosure 58. The plurality of holes 30 enables the user to select the hole 30 that provides the desired size for the enclosure 58.

Figure 5B:
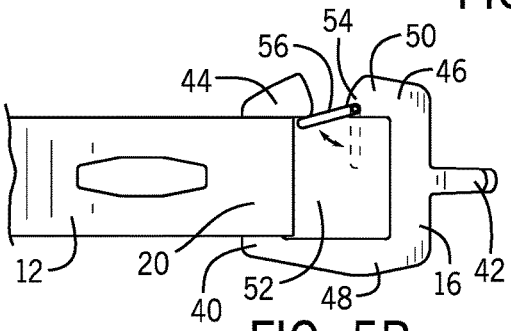
FIG. 5B is a top perspective view of a first region of a body of a strap and a buckle in accordance with another implementation of the present invention.

Referring to FIG. 5B, in one implementation, the buckle 16 can further include a gate 56 pivotally coupled to the buckle 16 at the gateway 54. The gate 56 can be spring loaded so as to be biased in a position that closes the gateway 54 but pivots or opens to allow for a portion of the body 12 to extend through the gateway 54 and into the opening 52 of the buckle 16. Once the portion of the body 12 has passed through the gateway 54 into the opening 52, the spring-loaded gate 56 can return to its closed position. In the implementation of FIG. 5B, the gate 56 is pivotally coupled to the second side region 50 toward the distal region 46 of the buckle 16. In another implementation, the gate can be pivotally coupled to the second side region toward the proximal region of the buckle.

Referring to FIGS. 1-5A and 8, the prong 42 outwardly extends from the distal region 46 of the frame 40. The prong 42 is sized to releaseably and selectively engage any one of the holes 30 of the body 12. In one implementation, the prong 42 is shaped, curved and/or angled to facilitate the engagement of the prong 42 and the buckle 16 with the body 12. The prong 42 engages the selected hole 30 and is sized and shaped to retain the engagement of the buckle 16 and the body 12 regardless of the existence or absence of tension on the body 12 until the user selectively disengages the hole 30 of the body 12 from the prong 42. Referring to FIG. 3, in one implementation, the prong 42 can extend at an angle $\alpha$ of at least 10 degrees from a plane defined by the frame 40. In another implementation, the angle $\alpha$ can be at least 20 degrees.

Figure 9:
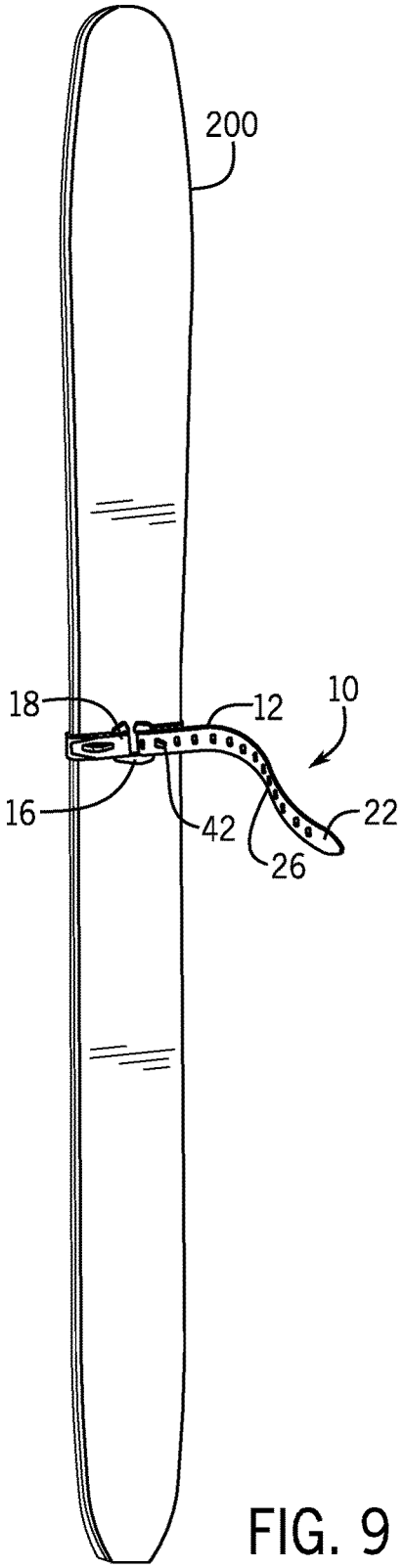
FIG. 9 is a front perspective views of the strap of FIG. 1 being positioned and releasably retained about a pair of skis.
Figure 10:
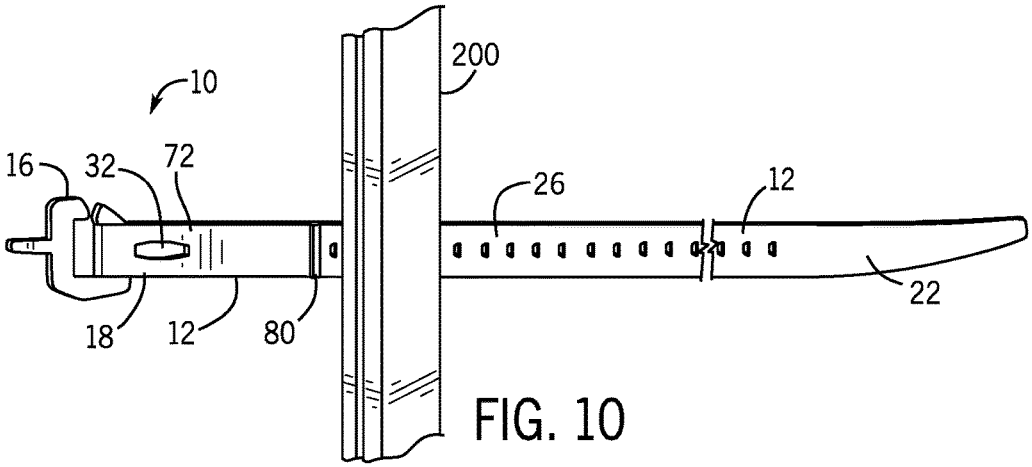
FIGS. 10 through 14 are perspective views of the strap of FIG. 1 being positioned about and releasably retained to the pair of skis of FIG. 9

FIGS. 9 through 14 illustrate the strap 10 being secured about a pair of skis 200 by a user to retain the skis. FIG. 9 illustrates the strap 10 applied to the pair of skis 200 including a representation of the relative sizes of the strap 10 and the skis 200 For illustration purposes, in FIGS. 10 through 14, in order to illustrate the strap 10 more clearly, the strap 10 is enlarged with respect to the skis 200, and the skis 200 are narrowed. Referring to FIGS. 1, 3 and 10, the curvature of the first region 22 of the strap 10 facilitates the user's ability to quickly to recognize the orientation of the strap 10 and to readily select the desired inner surface 72 to place against the skis.

Figure 11:
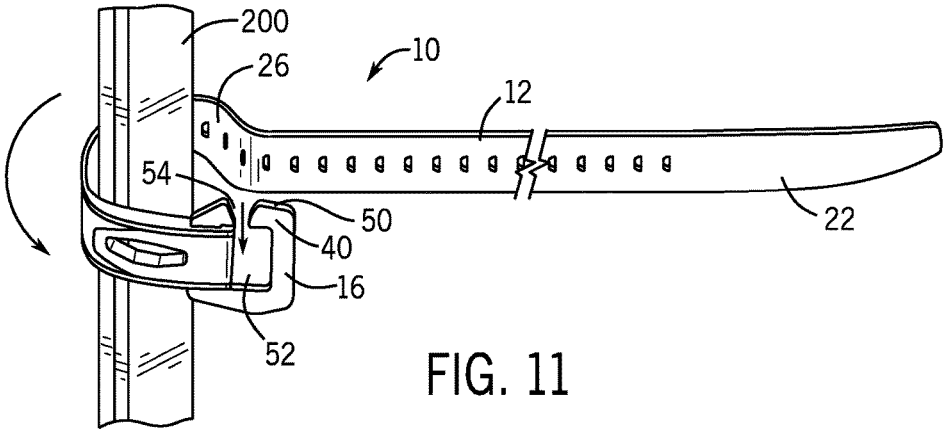
Figure 12:
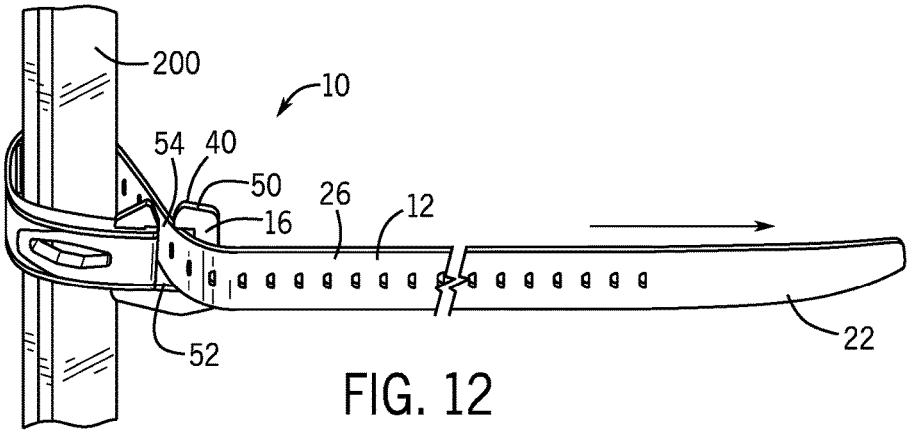
Figure 13:
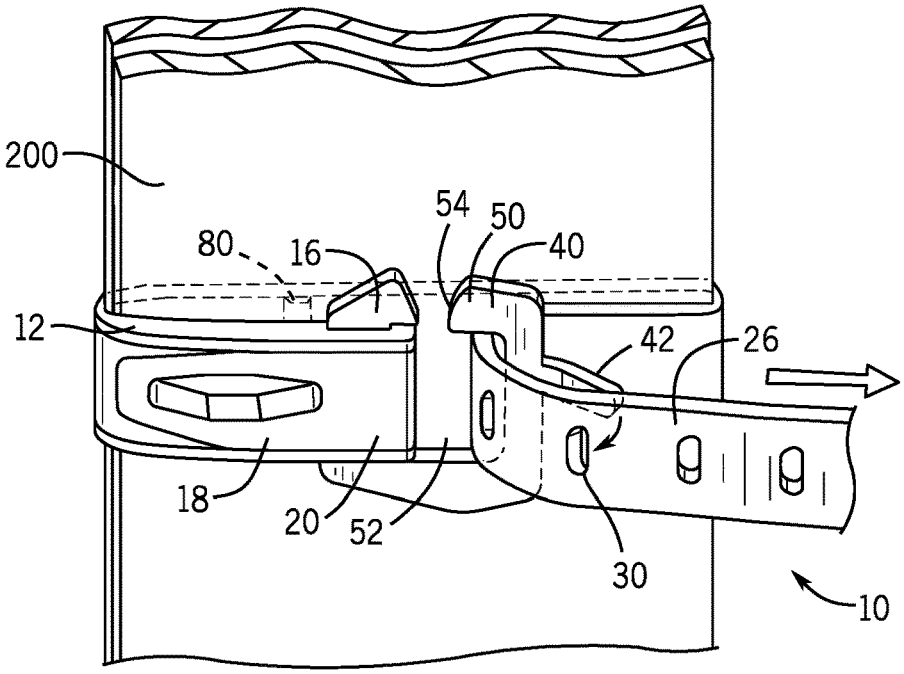
Figure 14:
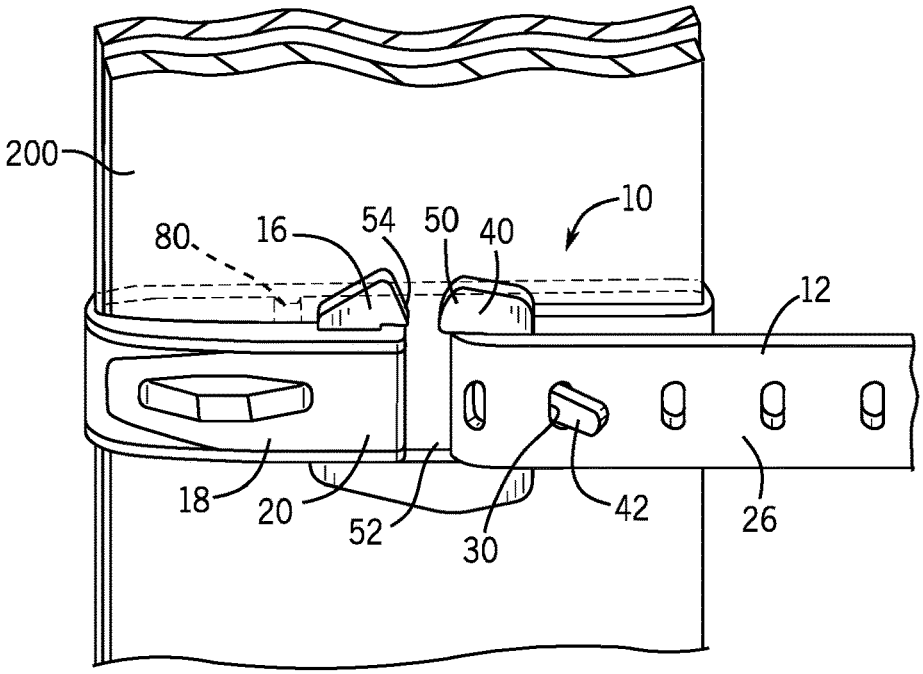

FIGS. 10-14 illustrate the wrapping of the strap 10 about the skis 200. FIG. 10 illustrates the skis 200 being placed over the central region of the strap 26 such that the skis rest against the inner surface 72 of the strap 10. FIGS. 11 and 12 illustrate the buckle 16 and the first region 18 being moved over and wrapped about the skis 200, and the central region 26 being positioned so as to slide through the gateway 54 in the second side region 50 of the frame 40 of the of the buckle 16, such that the central region 26 of the body 12 is positioned within the opening 52 of the buckle 16. The user does not have to thread the second end 24 and the second end region 22 of the body 12 through the central enlarged opening 52 in order to begin the engagement of the body 12 with the buckle 16, and the user doesn't have to continue to fish (or pass, push or pull) the central region 26 of the body 12 through the opening 52. Rather, by sliding the central region 26 of the body 12 through the gate 54 of the second side region 50 of the buckle 16, the user can be quickly ready to tighten and secure the strap 10 about the skis 200 (or other object). The user can slide the desired location of the second region 26 of the body 12 through the gate 54 of the buckle 16, which facilitates the wrapping process by avoiding the aligning and fishing through of the first end region 18 and the central region 26 through the opening 52 of the buckle 16. The present strap 10 with the gateway 54 enables users to perform the steps of moving the central region 26 of the body 12 of the strap 10 through the gateway 54 and into the opening 52 of the buckle 16 with one hand, if desired. In contrast, aligning and fishing or extending the second end region 18 and the central region 26 of the body 12 through the opening 52 of the buckle 16 without using the gateway 54 requires two hands. Accordingly, the positioning and retention of the strap 10 about the skis 200 or other article is able to be performed more quickly and easily. The steps are significantly easier for a user to perform than the steps of having to align the second end 24 of the body 12 of the strap 10 to be inserted through the opening 52 of the buckle 16, and then fishing the rest of the second region 22 and a portion of the central region 26 through the opening 52. FIGS. 13 and 14 illustrate the engagement of the buckle 16 to the central portion 26 of the body 12 including extension of the prong 42 through a selected hole of the plurality of holes 30 of the body 12. FIG. 9 illustrates the strap 10 secured to the pair of skis securing the skis together for safe storage or transportation.

Figure 15:
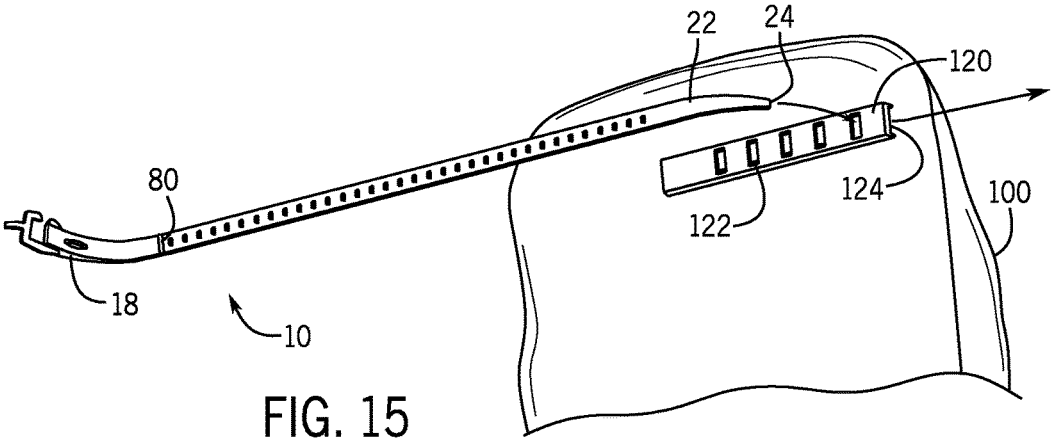
FIGS. 15 through 18 are perspective views of the strap of FIG. 1 being positioned and releasably retained to a bracket on a panel of a backpack.
Figure 16:
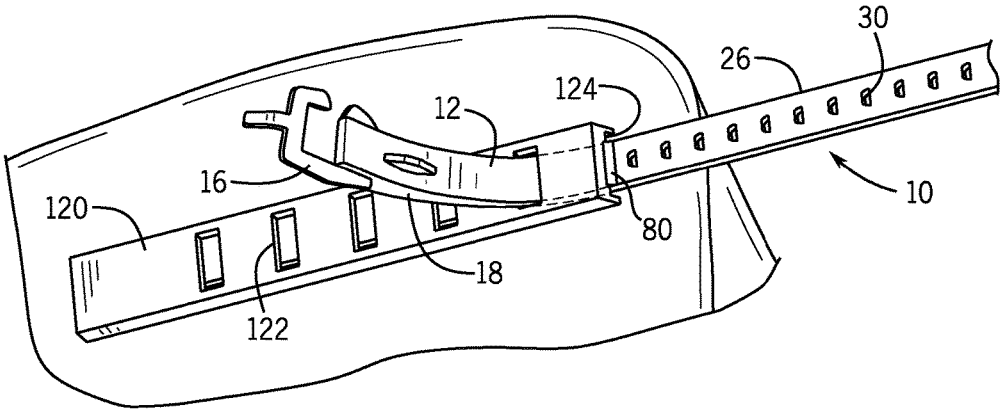
Figure 17:
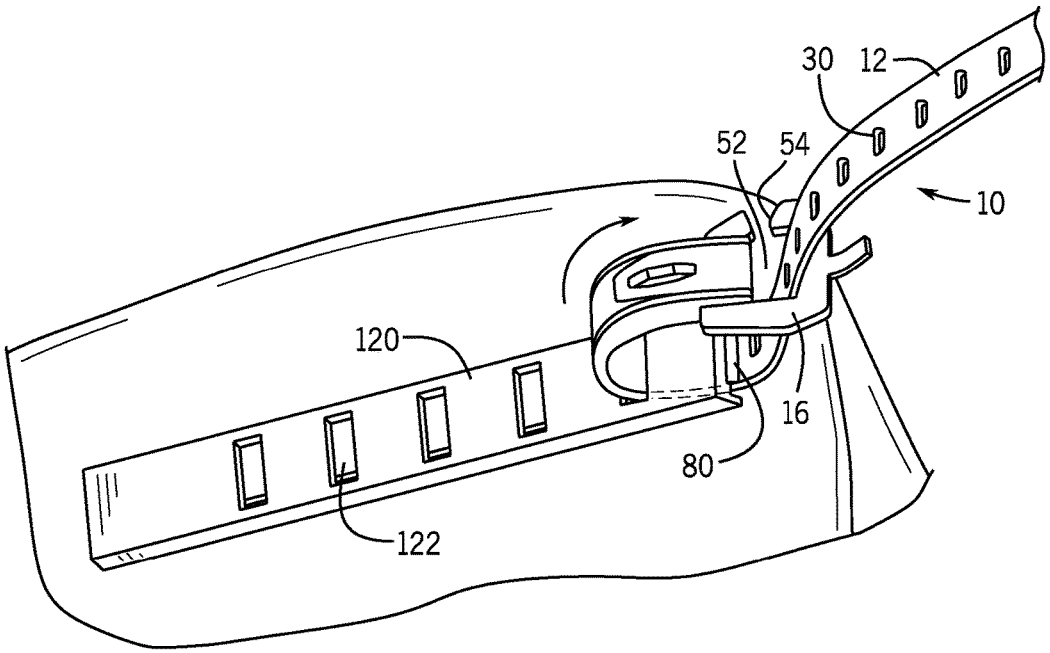
Figure 18:
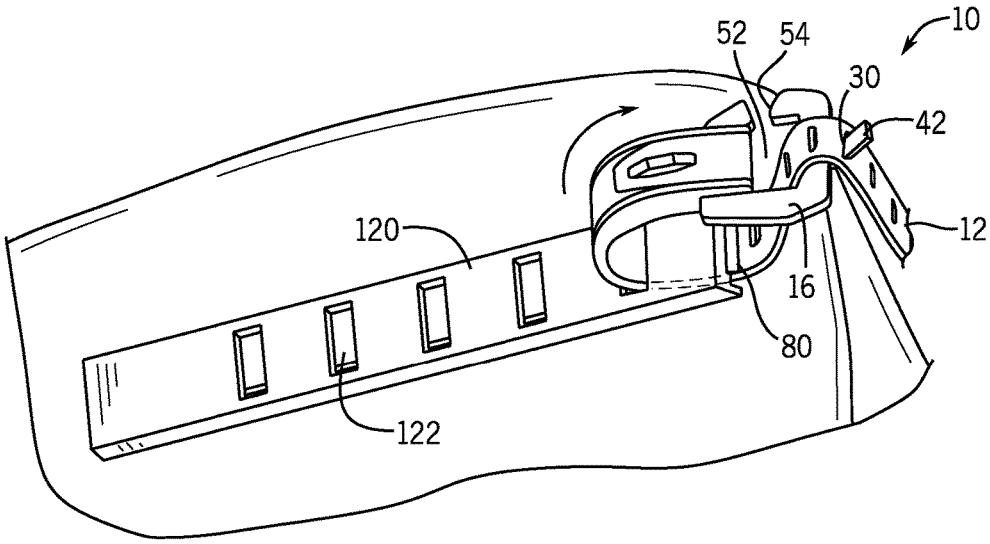

FIGS. 15 through 18 illustrate the releasable attachment of the strap 10 to the backpack 100. FIG. 15 illustrates the backpack 100 including a support bracket 120. The support bracket 120 is coupled to a panel of the backpack 100 and is configured for adjustably connecting articles to the backpack 100 including the strap 10 (or the strap 10 wrapping around an article and attached to the backpack). In one implementation, the support bracket 120 is stitched to the backpack 100. In other implementations, the bracket 120 can be coupled to the backpack 100 through thermal bonding, chemical bonding, snap-fit connections, rivets, other fasteners, stitching and combinations thereof. The support bracket 120 can include a plurality of outwardly facing spaced-apart slots 122 that are advantageously sized to receive the strap 10 and to allow for the selective positioning of the strap 10 to the bracket 120. The support bracket 120 further includes at least one end slot 124 that allows the strap 10 to extend out from between the bracket 120 and the panel of the backpack 100. FIG. 16 illustrates the first second end region 22 and the central region 26 inserted through one of the slots 122 and then through the end slot 124. FIGS. 17 and 18 illustrate the insertion of the central region 26 of the body 12 into the gateway 54 of the buckle 16 so that the body 12 is positioned within the opening 52 of the buckle 16.

Referring to FIGS. 16 through 18, in one implementation, the first region 18 of the body 12 can include a transverse tab 80 that is sized to resiliently extend through one or more of the slots 122 and the end slot 124 where it serves as a retention element or stop for retaining the strap 10 to the support bracket 120 and the backpack 100. FIG. 18 shows the strap 10 retained to the backpack 100 with the prong 42 of the buckle 16 extending to one of the slots 30 and the transverse tab 80 positioned adjacent to the end slot 124 of the support bracket 120. In this position, the strap 10 is available for later use by the user for securing skis or other articles. In one implementation, the spaced apart slots 122 and/or the end slot 124 can be sized to create and interference fit between the support bracket 120, the backpack 100 and the body 12 of the strap 10. The interference fit between the strap 10 and the bracket 120 enables to readily select how much of the body 12 to extend through the bracket 120. In another implementation, the spaced-apart slots 122 and the end slot 124 can be sized so as to form an interference fit only with the transverse tab 80 of the strap 10.

Figure 19:
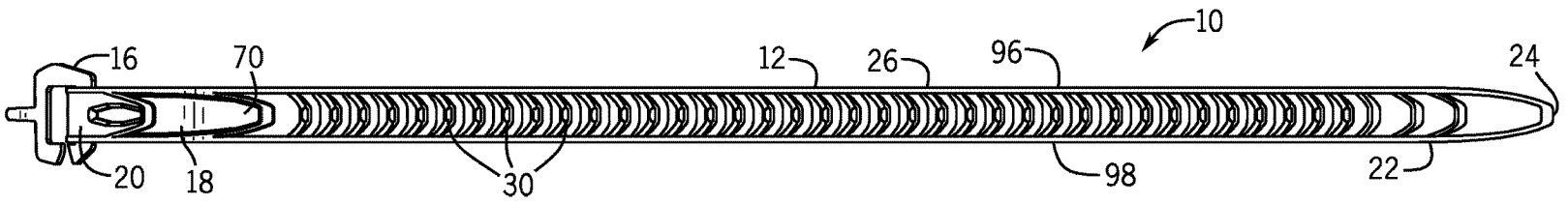
FIG. 19 is a top view of a strap according to another implementation of the present invention.
Figure 20:
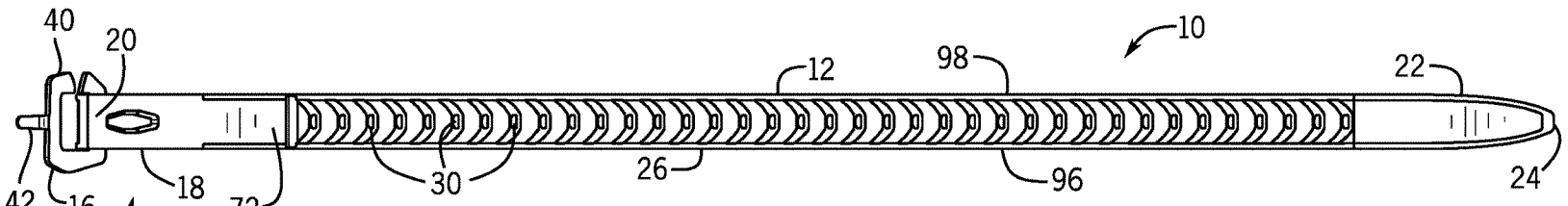
FIG. 20 is a bottom view of the strap of FIG. 19.

FIGS. 19 and 20 illustrate another implementation of the strap 10. The strap 10 can include a plurality of spaced-apart, transverse grooves and/or ridges 90 about the body 12. The grooves and/or ridges 90 can extend along one or both of the inner surface 70 and the outer surface 72 of the body 12. The body 12 can also include first and second side surfaces 96 and 98 and one or more of the grooves and/or ridges 90 can extend from the first side surface 96 to the second side surface 98. In other implementations, the grooves and/or ridges can extend only between the first and second side surfaces. The grooves and/or ridges 90 provide increased texture to the strap 10 making it easier to grasp and manipulate. The grooves and/or ridges 90 extend along the entire central region 26 or just a portion thereof. In other implementations, the grooves and/or ridges 90 can also extend into the second end region 22. The grooves and/or ridges 90 can be angled, straight, curved or irregular in shape. The grooves and/or ridges 90 provide a unique, pleasing aesthetic to the strap 10.

The present invention provides numerous advantages over existing straps for retaining sports and outdoor recreational articles, such as skis. The present invention provides a strap for retaining sporting and outdoor recreational articles, such as skis, that is easy to use and requires little time to engage about and retain such articles. The present invention provides a strap for retaining articles that is intuitively easy to orientate and use. The strap of the present invention retains its connection even when not under tension. Further, the present invention provides an improved strap that meets these needs while also providing an improved, pleasing aesthetic.

While the preferred embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner. While implementations of the present invention have been described and illustrated, numerous departures therefrom can be contemplated by persons skilled in the art.

What is claimed is:

1. A strap for releasably retaining one or more articles, the strap comprising:

a flexible elongate body having a first region adjacent a first end of the body, a second region adjacent a second end of the body, and a central region positioned between the first and second regions, the central region of the body defining a plurality of spaced apart fastening holes, the first region defining a strap opening for receiving the second end of the strap and releasably engaging a portion of the body; and a buckle coupled to the first end, the buckle including a frame including a proximal region coupled to the first end of the body, a distal region, and first and second side regions between the proximal and distal region, the second side region including a gateway for releasably receiving any region of the body.

2. The strap of claim 1, wherein the first region includes a transverse tab outwardly extending from a first side of the body.

3. The strap of claim 1, wherein the buckle further includes a prong, and wherein the prong is configured to releasably extend through and engage one of the plurality of holes of the body.

4. The strap of claim 3, wherein the prong forms an angle with respect to the frame that is at least 10 degrees.

5. The strap of claim 1, wherein the strap opening is sized to adjustably and releasably engage a portion of the body through an interference fit.

6. The strap of claim 5, wherein the elongate body can extend along a longitudinal axis, wherein the strap opening has a major dimension and a minor dimension, and wherein the major dimension extends about the longitudinal axis.

7. The strap of claim 1, wherein the buckle is pivotally connected to the first end of the body, and wherein the gateway in the second side region forms a gap of at least 10 mm.

8. The strap of claim 1, wherein the plurality of spaced apart fastening holes are rectangularly-shaped, ovalar-shaped, polygonal shaped, irregularly-shaped or a combination thereof.

9. The strap of claim 1, wherein the second region of the body is tapered.

10. The strap of claim 1, wherein the elongate body has a top surface and a bottom surface, and wherein at least one of the top surface and the bottom surface includes a plurality of spaced apart, outwardly extending ridges extending along the central region of the body.

11. The strap of claim 10, wherein the top surface and the bottom surface each include a plurality of spaced apart, outwardly extending ridges extending along the central region of the body.

12. The strap of claim 1, wherein the body has a first length extending along a longitudinal axis, wherein the plurality of spaced apart fastening holes within the central region define a second length measured with respect to the longitudinal axis, and wherein the second length is at least 50 percent of the first length.

13. The strap of claim 1, wherein the plurality of spaced apart fastening holes are at least 10 spaced apart fastening holes.

14. The strap of claim 1, wherein the body has a first length extending along a longitudinal axis, and wherein the first length is sized to wrap around a pair of skis.

15. The strap of claim 1, wherein the first region of the body has a pre-formed curvature.

16. A backpack assembly comprising:

a backpack including a support bracket defining a plurality of spaced apart slots; and an elongate strap for selectable engagement with the support bracket, the strap including:

a flexible elongate body having a first region adjacent a first end of the body, a second region adjacent a second end of the body, and a central region positioned between the first and second regions, the first region including a transversely extending tab, the central region of the body defining a plurality of spaced apart fastening holes; and a buckle coupled to the first end, the buckle including a frame including a proximal region coupled to the first end of the body, a distal region, and first and second side regions between the proximal and distal region, the second side region including a gateway for releasably receiving any region of the body; and wherein each of the spaced apart slots are sized to releasably receive the first end of the body and to resiliently received the transverse tab, the tab when threaded through at least one of the slots forms a stop for facilitating retention of the strap to the support bracket.

17. The backpack assembly of claim 16, wherein the first region of the body defines a strap opening for receiving the second end of the strap and releasably engaging a portion of the body.

18. The backpack assembly of claim 16, wherein the buckle further includes a prong, and wherein the prong is configured to releasably extend through and engage one of the plurality of holes of the body.

19. The backpack assembly of claim 16, wherein the backpack further includes at least one tie for releasably retaining the strap.

20. The backpack assembly of claim 16, wherein the body of the strap has a first length extending along a longitudinal axis, wherein the plurality of spaced apart fastening holes within the central region define a second length measured with respect to the longitudinal axis, and wherein the second length is at least 50 percent of the first length.

* * * * *